US007575497B2

(12) United States Patent
Gehrig

(10) Patent No.: US 7,575,497 B2
(45) Date of Patent: Aug. 18, 2009

(54) ERECTOR SET FOR ARTISTIC STRUCTURAL DESIGNS

(76) Inventor: Michael Gehrig, 27 St. Thomas Pl., Malverne, NY (US) 11565

( * ) Notice: Subject to any disclaimer, the term of this patent is extended or adjusted under 35 U.S.C. 154(b) by 411 days.

(21) Appl. No.: 11/334,887

(22) Filed: Jan. 18, 2006

(65) Prior Publication Data

US 2006/0270308 A1 Nov. 30, 2006

Related U.S. Application Data

(60) Provisional application No. 60/644,953, filed on Jan. 18, 2005.

(51) Int. Cl.
*A63H 33/08* (2006.01)
*A63H 33/00* (2006.01)

(52) U.S. Cl. ..... 446/114; 446/126; 446/108

(58) Field of Classification Search ..... 446/108, 446/117, 118, 114, 122, 124, 127
See application file for complete search history.

(56) References Cited

U.S. PATENT DOCUMENTS

| | | | | | |
|---|---|---|---|---|---|
| 1,211,590 | A | * | 1/1917 | Kennedy | 446/99 |
| 2,386,853 | A | * | 10/1945 | Herrmann | 446/100 |
| 3,780,469 | A | * | 12/1973 | Hancovsky | 446/127 |
| 3,834,067 | A | * | 9/1974 | Koleczek | 446/69 |
| 4,071,244 | A | * | 1/1978 | Richards | 273/275 |
| 4,802,854 | A | * | 2/1989 | Davis | 434/159 |
| 5,163,862 | A | * | 11/1992 | Philips et al. | 446/114 |
| 5,735,723 | A | * | 4/1998 | von Oppen | 446/85 |
| 6,149,487 | A | * | 11/2000 | Peng | 446/114 |

* cited by examiner

*Primary Examiner*—Kien T Nguyen

(57) ABSTRACT

An erector set for creating artistic structural designs comprising: a base and a set of modular structural elements connectable to one another, said modular structural elements comprising stiff, arcuate members having v-shaped slots in the convex and/or in the concave surfaces thereof and having either a v-shaped slot or a taper on each of the end portions thereof, said tapered end portions being configured to mate with and be held within any of the said v-shaped slots in said convex or concave surfaces or in end portions of the said arcuate members.

1 Claim, 3 Drawing Sheets

ERECTOR SET FOR ARTISTIC STRUCTURAL DESIGNS

CROSS-REFERENCE TO RELATED APPLICATIONS

This application claims the benefit of U.S. Provisional Patent Application U.S. Ser. No. 60/644,953 which is hereby incorporated herein by this reference.

SPECIFICATION

The present invention relates to an erector set and more specifically to an erector set for creating artistic structural designs. In its broadest embodiments the erector set comprises a base and a set of modular structural elements connectable to one another. The modular structural elements comprise stiff, arcuate members having v-shaped slots in the convex and/or in the concave surfaces thereof and have either a v-shaped slot or a taper on each of their end portions. The tapered end portions are configured to mate with and be held within the v-shaped slots in the convex or concave surfaces of the arcuate members or in the end portions of those members.

The erector set can be used to create a virtually unlimited number of artistic designs by connecting the arcuate members in different configurations. The artistic capabilities of this design are best shown in the drawings.

Figure 1:
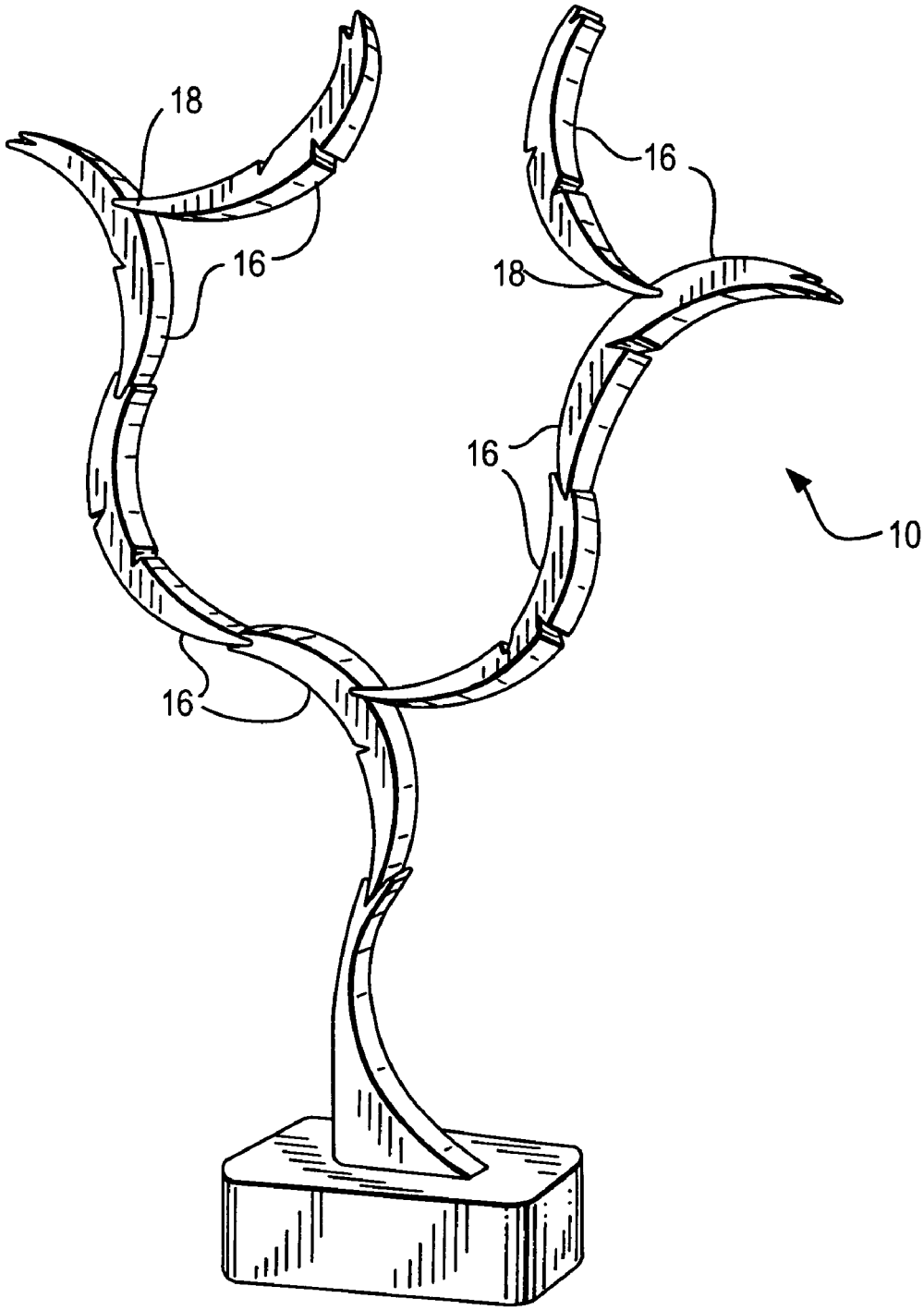
FIG. 1 is an overview of an artistic structural design created with the modular structural elements of the invention.
Figure 2A:
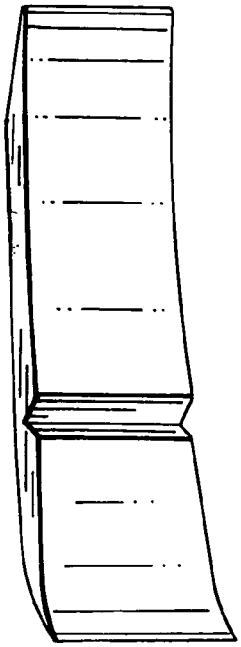
FIGS. 2A-2D are a series of photographs of one modular structural element showing the v-shaped slots and the end portions of the element.
Figure 2B:
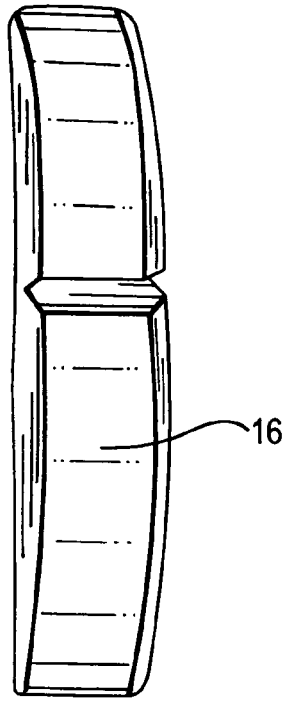
Figure 2C:
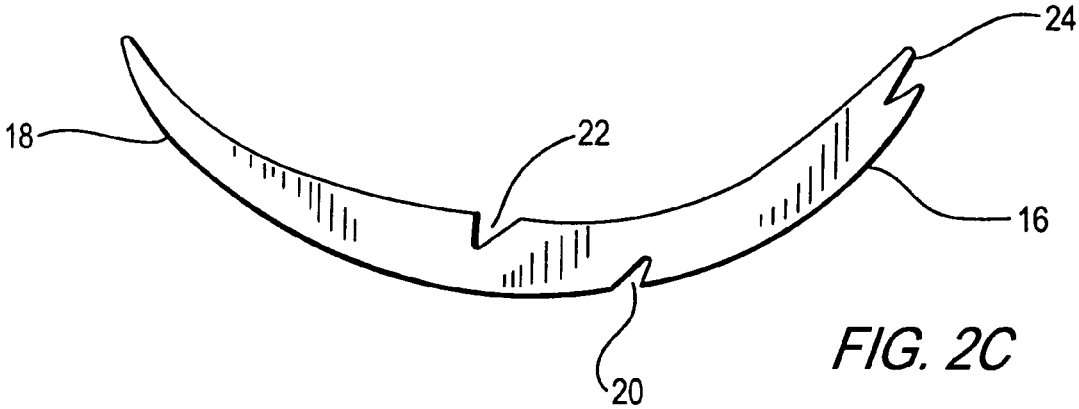
Figure 2D:
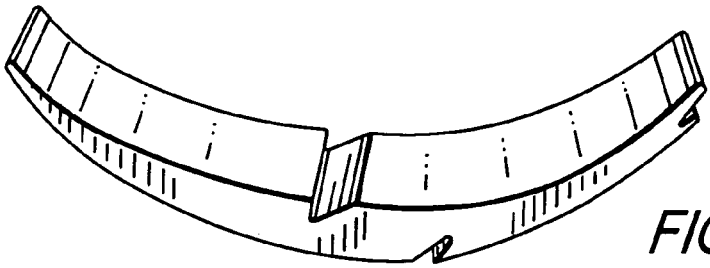

With reference to FIG. 1, reference 10 refers generally to an artistic structure which can be erected with the erector set of the invention. There are a virtually unlimited member of designs which can be created, as will be apparent from the following discussion.

Reference 12 refers to a foundation piece of the base which is preferably a solid block of suitable material such as wood. Affixed on foundation piece 12 is a vertically oriented support member 14 having a v-shaped slot in the upper end thereof for mating with and holding a tapered end portion of a modular element of the erector set. The erector set may contain multiple foundation pieces of different configuration and/or multiple support members of different configuration in order to provide variety and complexity.

Reference 16 refers to the multiplicity of modular structural elements with which the various artistic designs can be created. Each of the modular structural elements comprises a stiff, arcuate member, desirably made of wood or plastic, having a body portion which has v-shaped slots in its convex and/or concave surfaces. These v-shaped slots are best shown in FIGS. 2A-2D wherein reference numeral 22 refers to a v-shaped slot in the concave surface and reference numeral 20 refers to a v-shaped slot in the convex surface. Each of the modular structural elements has a tapered end portion, seen in FIG. 1 and in FIG. 2C at reference numeral 18. Reference numeral 24 shows an end portion of the modular structural element having a v-shaped slot, not unlike the v-shaped slots 20 and 22. Tapered end portion 18 is sized to mate with and be held within any of the v-shaped slots in the convex or concave surfaces of another modular structural element or to mate with and be held within a v-shaped slot in an end portion of another modular element. In preferred embodiments, the v-shaped slots 20 and 22 are slightly larger in size than the tapered end portions 18 of the modular structural elements. This allows for changes in balance and shifting of weight as construction proceeds. In still other embodiments, the v-shaped slots 20 and 22 may have partially enclosed sides.

Figure 3:
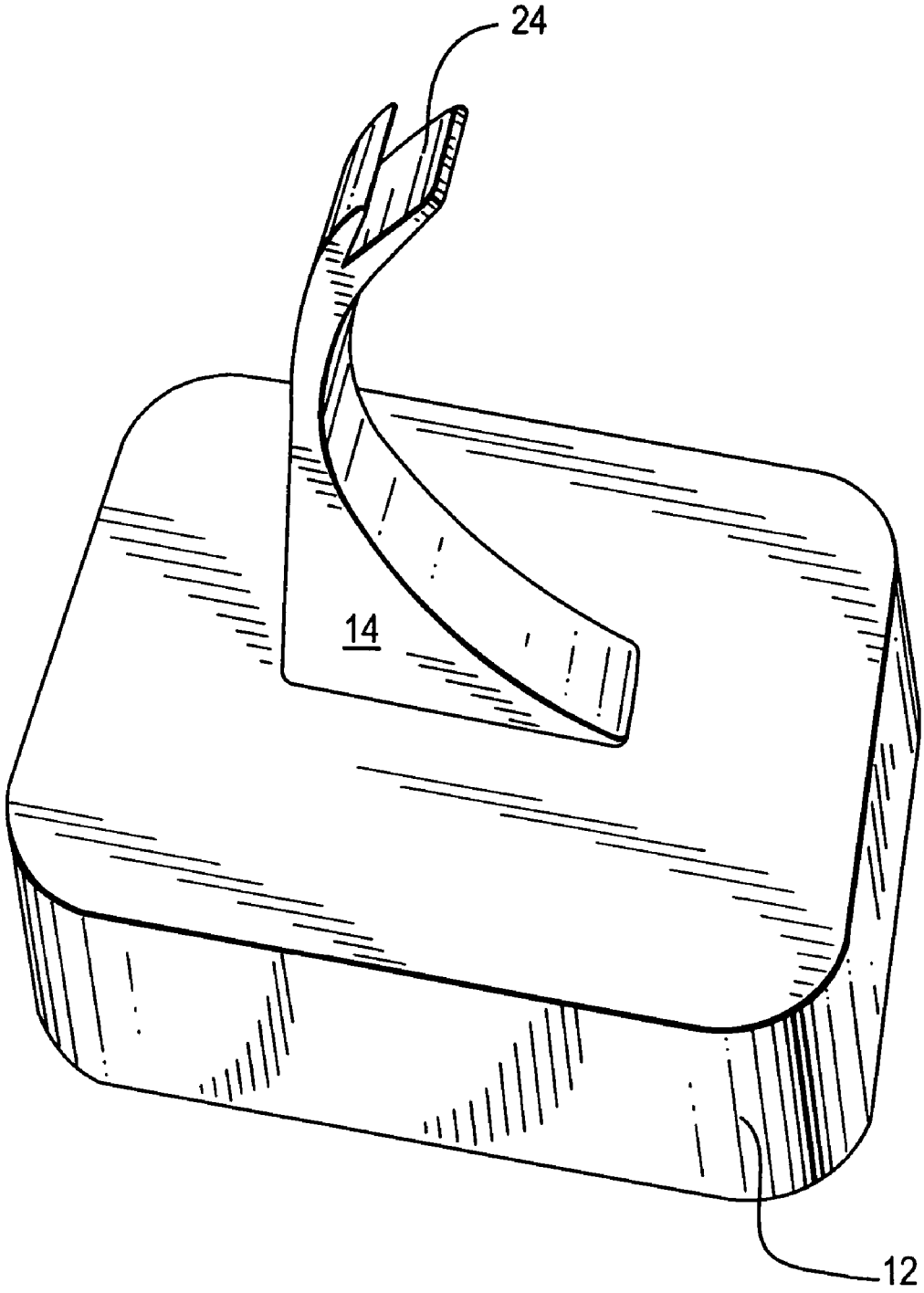
FIG. 3 is a photograph of the base of the erector set.

With reference to FIG. 3, the upper end of vertically oriented support member 12 has a v-shaped slot which mates with a tapered end portion, e.g. tapered end portion 18, of a modular element. Once the first modular element is supported within support member 14 at slot 24, the design may branch out into any number of configurations, one of which is shown in FIG. 1.

Preferably the arcuate modular members describe an arc of from 20 to 50 degrees. In another preferred embodiment the arcuate member may be tapered at both ends, one such tapered end having the above-described v-shaped slot.

What is claimed is:

1. An erector set for creating graceful, non-representational artistic structures comprising:

(a) a base;

(b) a support member comprising a lower portion permanently affixed to the center of said base adapted to support a structure thereupon and an upper portion comprising a substantially vertically-oriented, arcuate member having a v-shaped slot opening upwardly in the upper end thereof; and (c) a plurality of identical, modular, structural elements, each such element comprising a stiff, arcuate member subtending an arc of from 20 to 50 degrees and comprising a mid-section with lower and upper surfaces, the said lower and upper surfaces of said mid-section each having a v-shaped slot therein, and each said element further including a flat, tapered, male end portion and a flat, tapered, female end portion having a v-shaped slot therein, the said male end portion of each of said elements being sized to be received in and structurally retained by the said v-shaped slot in the upper portion of said support member, or in a said v-shaped slot comprising the female tapered end of another arcuate member, or in a said v-shaped slot in the said upper or lower surface of another arcuate member.

* * * * *